United States Patent [19]

Lerner

[11] Patent Number: 4,639,958

[45] Date of Patent: Feb. 3, 1987

[54] COMBINED HEAD REST, SUN SHADE AND BAG

[76] Inventor: Reuben Lerner, 88 Arlozorov Street, Holon, Israel

[21] Appl. No.: 740,011

[22] Filed: May 31, 1985

Related U.S. Application Data

[63] Continuation of Ser. No. 478,255, Mar. 24, 1983, abandoned.

[30] Foreign Application Priority Data

Jan. 31, 1983 [IL] Israel ..... 67800

[51] Int. Cl.[4] ..... A47G 8/06; A45C 9/00; B65D 30/00

[52] U.S. Cl. ..... 5/418; 383/3; 190/1; 5/434

[58] Field of Search ..... 5/418, 419, 434, 441, 5/440; 135/87, 95, 96, 102, 105, 101, 116, 118, 120; 160/68 R; 206/315.2–315.2, 315.8; 220/72.1; 190/2, 1; 224/151, 153, 156, 202; 296/1, 2; 383/3, 4; 52/2

[56] References Cited

U.S. PATENT DOCUMENTS

| | | | |
|---|---|---|---|
| 1,746,833 | 2/1930 | Hermansen | 5/441 |
| 1,827,477 | 10/1931 | Kotausek | 5/418 |
| 1,927,471 | 9/1933 | Salomon | 190/1 |
| 2,167,219 | 7/1939 | Sankey | 135/102 |
| 2,462,215 | 2/1949 | Norman et al. | 383/3 |
| 2,802,478 | 8/1957 | Fritsche | 135/105 |
| 2,915,074 | 12/1959 | Cameto | 52/2 |
| 2,932,833 | 4/1960 | Wambach | 5/434 |
| 3,241,160 | 3/1966 | Escobar | 5/418 |
| 3,840,919 | 10/1974 | Middleton | 135/96 |
| 4,425,675 | 1/1984 | Victor | 5/440 |

FOREIGN PATENT DOCUMENTS

| | | | |
|---|---|---|---|
| 856656 | 8/1940 | France | 5/418 |
| 1988812 | 6/1923 | United Kingdom | 206/315.2 |

*Primary Examiner*—Gary L. Smith
*Assistant Examiner*—Vinh Luong
*Attorney, Agent, or Firm*—Renner, Otto, Boisselle & Lyon

[57] ABSTRACT

There is provided an article for use by persons lying on the ground at the sea or like locations.

The device serves as a head rest for the reposing person and as a sun shade. When not in use as stated, the device serves as a carrying bag.

7 Claims, 5 Drawing Figures

COMBINED HEAD REST, SUN SHADE AND BAG

This is a continuation of co-pending application Ser. No. 478,255 filed on Mar. 24, 1983, now abandoned.

BACKGROUND OF INVENTION

This invention relates to a head rest and sun shade for use by persons who wish to lie down on the ground, e.g. on the beach.

It has been experienced that for such purposes it would be desirable to combine with the head rest and sun shade also a means which would permit the taking along of articles needed by the respective person in a more convenient manner as is being practised, e.g. by carrying such articles in a separate bag.

SHORT SUMMARY OF DISCLOSURE

The invention thus concerns a head rest and sun shade, the said head rest being constituted by a closable bag which is either carried on a stiff skeleton to which latter a foldable sun shade is attached, or which is inflatable.

In one practical embodiment of the invention the closable bag is attached to a skeleton formed by a bar bent to the shape of two substantially semi circular bows which are connected by two cross bars extending between the two ends of the two bows, the said bag being held between and being stretched on the said bows, at least two further bows being hingedly attached to the said first named bows, substantially at the zenith thereof, a sheet being held on the said second bows.

In an alternative, practical embodiment, the bag is made of air tight material and is provided with a non return valve, permitting its being inflated, a number of bow shaped tubular members which are exteriorily connected with one another to form a canopy and which are in communication with the interior of the said air tight bag and are inflatable together with it, being provided.

SHORT DESCRIPTION OF DRAWINGS

The invention will now be described in detail with reference to the accompanying drawings wherein FIGS. 1 and 2 show the first, and FIGS. 3, 4, 5 the second practical embodiment of the invention. FIG. 1 being a perspective view of the new head rest in condition of use, while FIG. 2 is a like view with the sun shade folded and forming a carrying handle.

Figure 5:
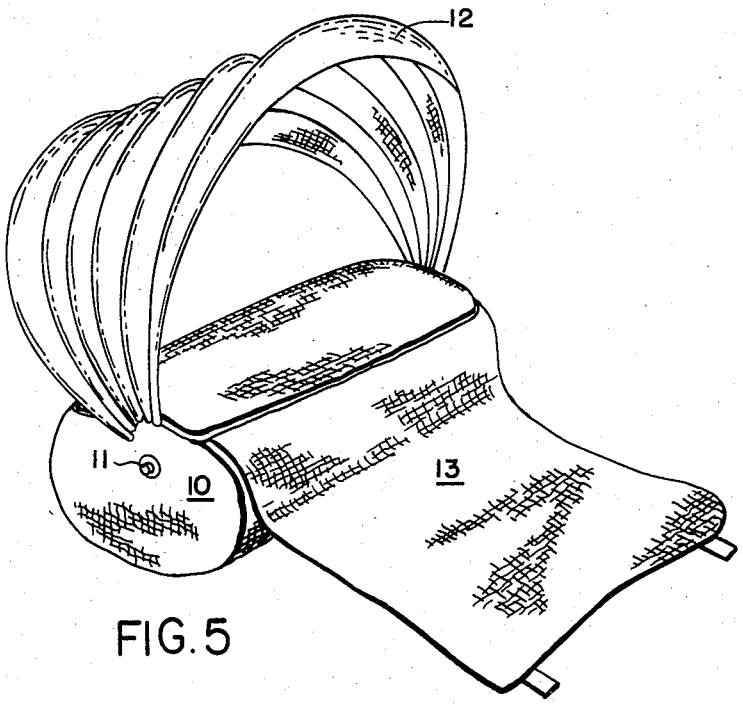

FIG. 5—finally—is a perspective view of the new device in condition of use.

DETAILED DESCRIPTION OF PREFERRED EMBODIMENT

Figure 1:
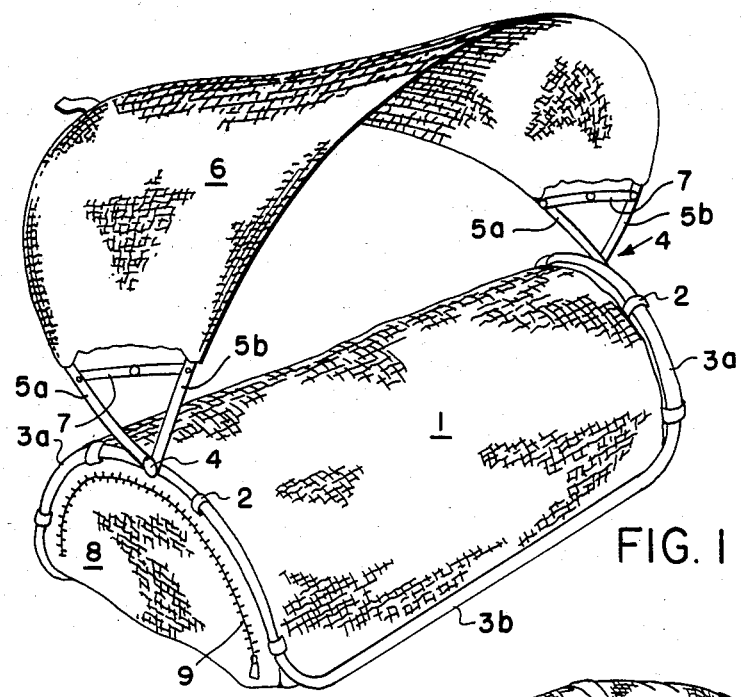

Turning first to FIG. 1, the head rest is formed by a bag 1 which is substantially of the shape of half a cylinder and which is affixed by shackles or loops 2 to a skeleton 3 on which it is held stretched. The skeleton is formed by a bar, preferably of metal, bent to form two semi circular bows 3*a* which are positioned in two parallel planes. The ends of the bows are connected by straight rods 3*b*.

The said skeleton will preferably be bent to its described shape from one length or bar, but it would be within the scope of the invention to assemble it from several pieces, welded or otherwise connected with one another.

From the zenith of the two bows 3*a*, and hingedly attached thereto at 4 extend two further bow shaped members 5*a* and 5*b*. On the two bows 5*a*, 5*b* is stretched a textile or plastics sheet 6, forming a canopy. The two bows 5*a*, 5*b* are interconnected by two links 7, which—consist of two pivotally connected parts, and which—in the erect state—hold the bows 5*a* and 5*b* apart from one another and thus stretch the sheet 6.

At its lateral end the bag is closed by a flap 8 which can be secured by a slide fastener 9.

Figure 2:
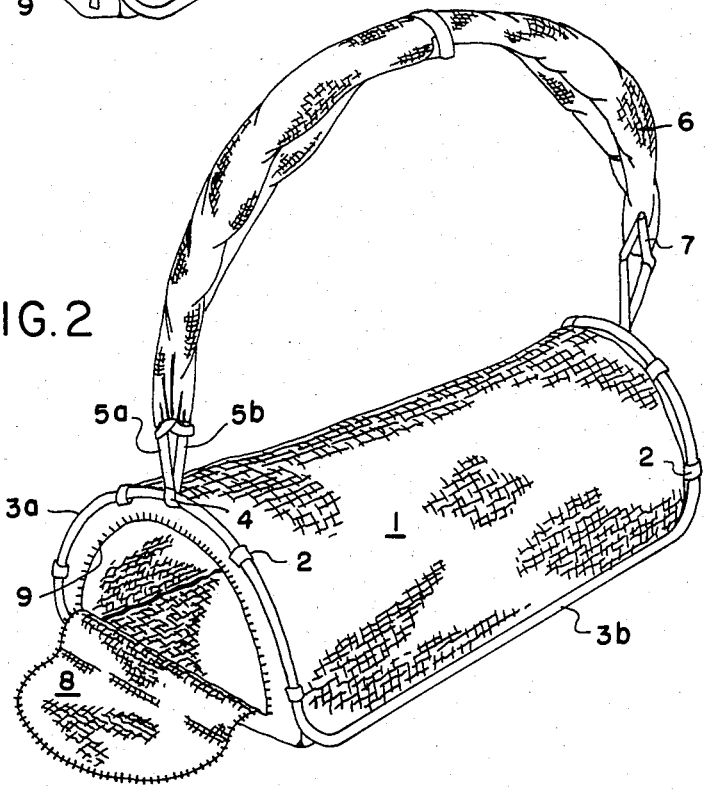

When not in use and being carried, the two bows 5*a* and 5*b* are folded onto one another, as shown in FIG. 2, and the sheet 6 is wrapped around the folded bows, so forming a carrying handle.

Figure 3:
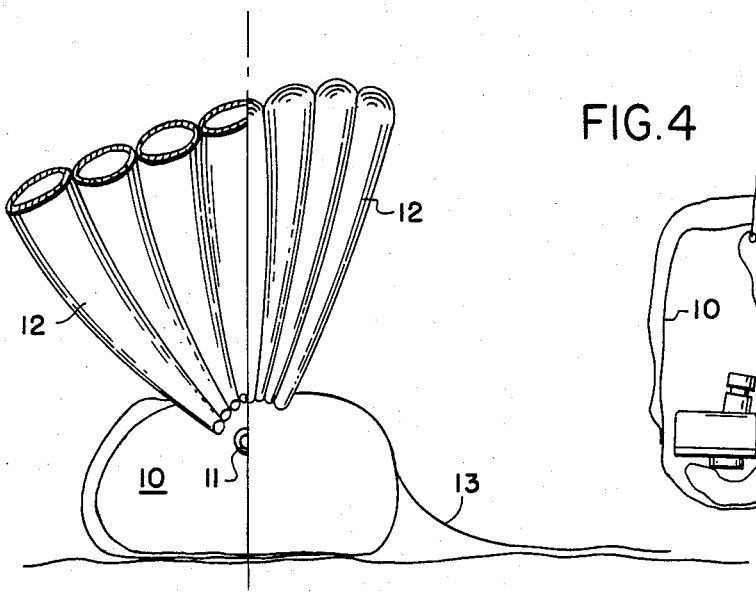
FIG. 3 shows, partly in section and partly in elevation the second practical embodiment of the new device.

Turning now to the second embodiment, there is shown in FIG. 3 a bag 10 which can be inflated by means of a conventional non-return valve 11. With the interior of bag 10 there are in communication a number of tubular bow shaped bodies 12 which are exteriorily connected with one another. When air is blown into bag 10 through valve 11 it becomes inflated and the tubular bows 12 become erect. In this erect condition they form together a canopy, as shown in FIG. 5.

The bag will consist of air tight material as will the tubular bows. To the outside of the bag 10 is attached a ground sheet 13 which—when the device is not in use, is wrapped around the bag.

Figure 4:
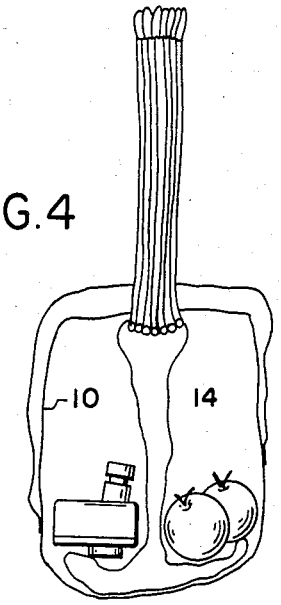
FIG. 4 is a sectional view of the head rest cum sun shade, with the canopy forming tubular members folded onto one another.

Preferably the bag 10 is made of non air tight material, say sail cloth and forms the container in which various articles can be carried (see FIG. 4). In that case within the bag 10 would be provided an inflatable bladder 14 with which the bow shaped tubular members 12 communicate.

When the device is to be used as a head rest, the articles carried therein are preferably removed therefrom, the bladder 14, together with tubular bows 12 is inflated and the whole assumes the shape shown in FIG. 5.

It will be seen that both embodiments will serve as a head rest, in the first embodiment the bag is stretched on the skeleton but retains an inherent flexibility, aided by a certain springiness of skeleton 3, so that the user will conveniently rest thereon. The created canopy gives the desired protection against sun shine.

In a like manner the second embodiment serves its purpose. Once inflated, the bag 10 forms an air cushion on which the head of a person reposes, fully protected by the canopy 12.

A ground sheet—although not shown in FIGS. 1 and 2—can form part of this embodiment.

I claim:

1. A device for use as a head rest and sun shade and a bag for carrying articles therein, comprising a stiff skeleton, a closable bag supported on said skeleton to provide a flexible head rest, and a foldable sun shade connected to said skeleton, said skeleton including laterally spaced apart, upright side frame members at respective lateral ends thereof and connecting frame means separate from said closable bag extending laterally between said side frame members to connect said side frame members, said bag having a flexible upper portion extending between and stretched by said frame members and said frame members supporting said flexible upper portion against collapse onto a lower portion of said bag to provide the flexible head rest and further to provide between said upper and lower portion a hollow space within said bag for storage of articles in said bag even during use of said device as a head rest, and said flexible upper portion being attached at its lateral ends to said upright side frame members by loops.

2. A device as set forth in claim 1, wherein said skeleton is formed by a bar bent to the shape of two substantially semi-circular bows which are laterally spaced apart and connected by two cross bars extending between respective ends of said bows, said upper portion of said bag being held between and stretched by said bows, and said sun shade including two further bows hinged to said bows of said skeleton substantially at midpoints of said bows of said skeleton and a sheet held on said further bows.

3. A device as set forth in claim 1, wherein said sun shade when folded is usable as a handle to carry said bag.

4. A device as set forth in claim 1, wherein said upright side frame members include two substantially semi-circular upright bows at respective lateral ends of said skeleton and between which said flexible upper portion of said bag is stretched and held convexly curved generally about an axis extending laterally of said skeleton.

5. A device as set forth in claim 1, wherein said shade is arcuate and connected at its ends to respective lateral ends of said skeleton.

6. A device as set forth in claim 1, wherein said bag is closable at one end by means of a flap.

7. A device as set forth in claim 1, wherein said bag generally has the shape of a diametrical half of an axially elongated cylinder.

* * * * *